US005490696A

United States Patent [19]

Hutson

[11] Patent Number: 5,490,696

[45] Date of Patent: Feb. 13, 1996

[54] DOOR LOCKING SYSTEM

[75] Inventor: Ozzie B. Hutson, Spartanburg, S.C.

[73] Assignee: Fortruss, Inc., Greenville, S.C.

[21] Appl. No.: 138,420

[22] Filed: Oct. 18, 1993

Related U.S. Application Data

[63] Continuation-in-part of Ser. No. 978,139, Nov. 18, 1992, Pat. No. 5,253,905.

[51] Int. Cl.[6] ..... E05B 65/10

[52] U.S. Cl. ..... 292/92; 292/139; 292/259 R

[58] Field of Search ..... 292/92, 21, 9, 292/15, 23, 35, 93, 94, 139, 193, 259 R, 191, 192, 275, 300, DIG. 65, 42; 70/92; 49/141

[56] References Cited

U.S. PATENT DOCUMENTS

| | | | |
|---|---|---|---|
| 1,039,734 | 10/1912 | Hannum | 292/21 |
| 1,800,165 | 4/1931 | Waldron | 292/92 X |
| 2,188,642 | 1/1940 | Keats | 292/181 |
| 2,475,478 | 7/1949 | Clair | 292/179 X |
| 3,024,053 | 3/1962 | Cox et al. | 292/92 X |
| 3,724,130 | 4/1973 | Bogue | 292/259 |
| 3,958,820 | 5/1976 | Teeple | 292/181 X |
| 4,179,143 | 12/1979 | Shy | 292/179 |
| 4,552,392 | 11/1985 | Morello | 292/181 |
| 4,631,528 | 12/1986 | Handel et al. | 340/545 |
| 4,762,350 | 8/1988 | Hurtado | 292/259 |
| 4,779,910 | 10/1988 | Dameron | 292/259 |
| 4,785,286 | 11/1988 | Martin | 340/545 |
| 4,796,445 | 1/1989 | Norden, Jr. | 70/94 |
| 4,852,921 | 8/1989 | Gilbert et al. | 292/259 |
| 4,856,831 | 8/1989 | Roden, Jr. | 292/259 |
| 4,961,330 | 10/1990 | Evans | 292/21 |
| 4,968,070 | 11/1990 | Choi | 70/92 X |
| 5,010,747 | 4/1991 | Norden, Jr. | 70/94 |
| 5,139,292 | 8/1992 | Beals | 292/92 |

FOREIGN PATENT DOCUMENTS

| | | | |
|---|---|---|---|
| 3131501 | 2/1983 | Germany | 292/92 |
| 7000 | of 1904 | United Kingdom | 292/92 |
| 650193 | 2/1951 | United Kingdom | 292/92 |
| 846983 | 9/1960 | United Kingdom | 292/181 |
| 1330696 | 9/1973 | United Kingdom | 292/179 |

*Primary Examiner*—Rodney M. Lindsey

*Attorney, Agent, or Firm*—Leatherwood Walker Todd & Mann

[57] ABSTRACT

A door locking system for attachment to an outwardly opening door which engages the door frame and which has a panic bar movable towards the door for disengaging the locking system. The locking device includes an outer sleeve fixedly mounted to the interior surface of the door and extending over one side of the door frame. An inner sleeve is provided within the outer sleeve which is pulled outwardly to a door frame engagement position, wherein the inner sleeve extends over the other side of the door frame to prevent the door from being opened. Movement of the panic bar towards the door causes the inner sleeve to retract into the outer sleeve, thereby allowing the door to be opened. A reset system is provided for automatically resetting the lock when the door is closed.

17 Claims, 12 Drawing Sheets

DOOR LOCKING SYSTEM

This application is a continuation-in-part of pending application No. 07/978,139, filed Nov. 18, 1992.

BACKGROUND OF THE INVENTION

This invention relates generally to a door locking system for securing a door and for allowing emergency egress.

Outwardly swinging exit doors are often found in commercial buildings. In addition to the use of outwardly opening doors by commercial establishments, residential dwellings, and in particular mobile homes, also often include outwardly opening doors. In a commercial environment, these doors are often located at the rear of the building and provide a service entrance to the establishment. Such doors are very commonly used in shopping centers as back doors to stores in the shopping center. Because these doors generally open toward a service driveway or parking area generally shielded from public view, the doors are often the target of burglars who simply chain or tie the exterior door handle to a truck or other vehicle and pull the door completely out of its door frame to obtain entry into the store. This type of burglary technique is becoming more and more common, particularly in high crime areas.

Outwardly opening doors have become popular in large part because of fire code requirements. During a fire or other emergency, an outwardly opening door affords a more efficient egress from a building than an inwardly opening door. Further, panic-type latch release mechanisms inherently operate better on an outwardly opening door than would be possible for an inwardly opening door.

Countervailing problems arise, however, when a door locking mechanism is to be provided which on one hand prevents the door from being torn from its frame by exterior pulling, and on the other hand affords a release of the door latching mechanism during an emergency situation which is in compliance with fire code standards.

Generally, fire code standards require that a door latch release mechanism be actuatable by someone pushing horizontally against the release mechanism. Panic latch releasing devices which require other than such a horizontal pushing force for actuation have often been banned by fire inspectors.

Additionally, Underwriters Laboratories, Inc., a national products testing laboratory, has standards for panic-type door locks which prohibit the use of a spring to retract a locking member of a door lock system.

Several devices have been patented which include panic-type door latch release mechanisms. For example, U.S. Pat. No. 4,961,330, issued to Evans, discloses a door locking mechanism having a panic bar door lock release mechanism. U.S. Pat. No. 4,631,528, issued to Handel, et al., and U.S. Pat. No. 4,785,286, issued to Martin, each disclose panic bar door latch release mechanisms which also include alarms for signaling when the emergency door latch release mechanism has been actuated.

Other door locking devices have been patented which attempt to increase the security of a door by providing cross bar-type structures which prevent the inward opening of an inwardly opening door. U.S. Pat. No. 4,779,910, issued to Dameron, discloses a door locking device having receptacles attached to the door jamb for receipt of a lock bar assembly. U.S. Pat. No. 4,762,350, issued to Hurtado, illustrates an electrically operated locking device primarily for inwardly opening doors of a residential dwelling. While not illustrated, the patent suggests the possibility of attaching the electrically operated device to the exterior of a door.

For outwardly opening doors, devices have been patented which attempt to tie the door into the interior door frame. U.S. Pat. No. 4,796,445, issued to Norden, discloses a door locking mechanism having rotatable locking plates which may engage the door frame. U.S. Pat. No. 4,852,291, issued to Gilbert, et al., discloses a locking device attachable to a door knob which includes telescoping bars for contacting a door frame. U.S. Pat. No. 4,856,831, granted to Roden, discloses a door lock which includes a pair of restraining bars which contact the door facings adjacent the door. Finally, U.S. Pat. No. 5,010,747, issued to Norden, discloses a locking device having arms which are engagable with plates mounted in the door frame or with retainers mounted on the door frame.

Even in view of the above-patented devices, a need still exists for a high security door locking system for an outwardly opening door having an emergency release system which is acceptable under fire codes.

SUMMARY OF THE INVENTION

In view of the foregoing, it is an object of the present invention to provide a high security door locking system.

Another object of the present invention is to provide a door locking system with a panic release device which is operated by pushing it toward the door.

Another object of the present invention is to provide a door locking system which remains attached to a door when not in use.

Still another object of the present invention is to provide a door locking system of simple construction which does not require an electrical power source.

Yet another object of the present is to provide a door locking system which may be used in a variety of doors.

Another object of the present invention is to provide a door locking system which does not require a spring force for unlocking a door.

And, yet another object of the present invention to provide a door locking system having an alarm which is actuated when the panic release device is actuated.

A further object to present invention is to provide a door locking system which automatically resets itself to a locking configuration upon closure of the door.

Generally, these and other objects of the present invention are addressed by the present invention, one embodiment of which includes a door locking device for attachment to the surface of a door, the door being held within a door frame having first and second frame surfaces adjacent the door and spaced on opposite sides of the door from one another. The door is of conventional design, being latchable adjacent the first frame surface and being hinged adjacent the second frame surface for swinging outwardly away from the door frame.

The door locking device itself comprises a mounting structure for attachment to the surface of the door and retractable engagement means fixedly connected to the mounting structure for selectively engaging at least one of the first and second door frame surfaces adjacent the door. The retractable engagement means includes an engagement member being movable from an engagement position adjacent the first frame surface, for restraining the door from outward movement from the door frame, to a retracted position for allowing the door to move outwardly from the door frame.

Retraction means actuatable in a substantially horizontal plane and mechanically contactable with the engagement member are provided for selectively causing the engagement member to be maintained in the engagement position. Upon a predetermined force being delivered to the retraction means in a direction substantially perpendicular to the surface of the door, the retraction means causes the engagement member to move from the engagement position to the retracted position, thereby allowing the door to swing outwardly from the door frame.

More specifically, one embodiment of the locking device includes the retraction means having a pushbar pivotally connected to the retractable engagement means for pivotal movement between a first position and a second position about a substantially horizontal plane. The pivotal movement of the pushbar from the first position to the second position causes the engagement member to move from the engagement position to the retracted position. The retractable engagement means may include an outer sleeve fixedly attached to the mounting structure, where the engagement member is an inner sleeve carried in the outer sleeve for telescopic movement with respect to the outer sleeve. A spring is carried within the inner sleeve the spring biasing the inner sleeve inwardly towards within the outer sleeve, such that upon actuation of the retraction means, the spring forces the inner sleeve from the engagement position to the retracted position.

In an alternate embodiment, the door locking device comprises a mounting structure for attachment to the door and a support structure connected to the mounting structure. At least one restraining member is provided which is movable from a restraining position adjacent to and in front of the first outer frame surface of the door frame, for restraining the door from outward movement from the door frame, to a retracted position, for allowing the door to move outwardly from the door frame. A retraction structure is included which is movable from a first position to a second position. The retraction structure is connected to the restraining member for selectively causing the restraining member to be maintained in the restraining position, when the retraction structure is in the first position, such that upon a force being delivered to the retraction structure in a direction towards the door, the retraction structure moves to the second position and causes the restraining member to move from the restraining position to the retracted position, thereby allowing the door to swing outwardly from the door frame.

More specifically, in the alternate embodiment, the retraction structure includes a pushbar associated with the restraining member. The pushbar is movable in a substantially horizontal plane for causing the retraction structure to move from the first position to the second position, thereby causing the restraining member to move from the restraining position to the retracted position.

The support structure includes a support member attached to the mounting structure, and the restraining member is an elongated member carried by the support member for sliding movement relative to the support member.

The retraction structure includes a first link and a second link, each of the first and second links having a first end and a second end, the first end of each of the first and second links being connected to the pushbar for pivotal movement with respect to the pushbar. The second end of the first link is connected to support member for pivotal movement with respect to the support member, and the second end of the second link is pivotally connected to the elongated member for moving the elongated member upon movement of the retraction structure from the first position to the second position.

In still another alternate embodiment, a door locking system is provided which includes a mounting structure for attachment to the door and a support structure connected to the mounting structure. At least one moveable locking member associated with the support structure is provided, the locking member being movable from a locking position, for substantially fixing the door with respect to the frame, to a retracted position, for allowing the door to swing open from the frame. Also provided is an actuatable catch associated with the support structure and the locking member for retaining the locking member in the retracted position when the door is opened outwardly from the door frame. A release member is associated with the catch for automatically causing the catch to release the locking member upon movement of the door into the door frame, and a reset member is associated with the locking member for moving the locking member to the locking position upon the release member automatically actuating the catch.

BRIEF DESCRIPTION OF THE DRAWINGS

The foregoing, as well as other objects of the present invention, will be more apparent from the following detailed description of the preferred embodiment of the invention, when taken together with the accompanying drawings, in which.

DESCRIPTION OF THE PREFERRED EMBODIMENT

This application is a continuation-in-part of application No. 07/978,136, filed Nov. 18, 1992, the disclosure of which is incorporated in its entirety by reference.

Figure 1:
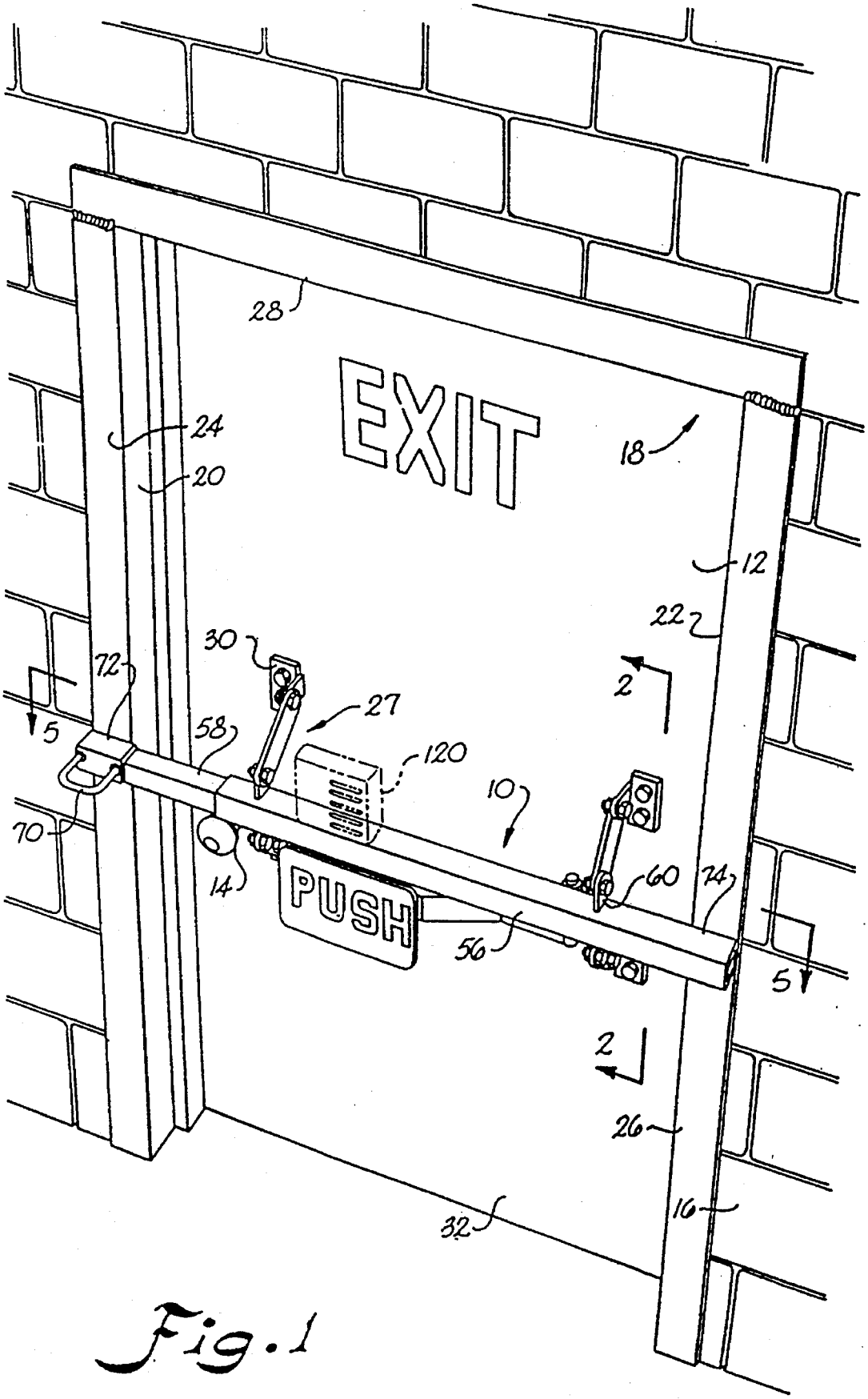
FIG. 1 is a perspective view of a door locking system constructed in accordance with the present invention attached to a door.

Referring to the drawings in detail, wherein like reference characters represent like elements throughout the various views, a door locking system constructed in accordance with the present invention is designated generally as 10 in FIG. 1.

FIG. 1 illustrates door locking system, generally 10, attached to a door 12 having a conventional door knob 14. Door 12 is mounted within wall 16 by means of a door frame, generally 18, which has first and second vertical frame members 20, 22, each having a respective frame surface 24, 26 which faces toward the interior of the building or room bounded by wall 16. Door frame 18 is of conventional construction, and is of the type which is generally constructed of steel. However, it is to be understood that door locking system 10 could also be used in connection with a door frame constructed of other materials, such as a metal other than steel, wood, plastic, fiberglass, etc. Door frame 16 includes an upper cross member 28 which is connected at the ends thereof to vertical door frame members 20, 22, respectively.

Door 12 is hinged by hinges (not shown) to door frame 18 such that door 12 swings outwardly from wall 16, and away from door frame surfaces 24, 26. Door 12 could be of conventional construction, and could be made of steel, wood, or some other suitable material, and also could be either of solid or hollow core construction.

Figure 2:
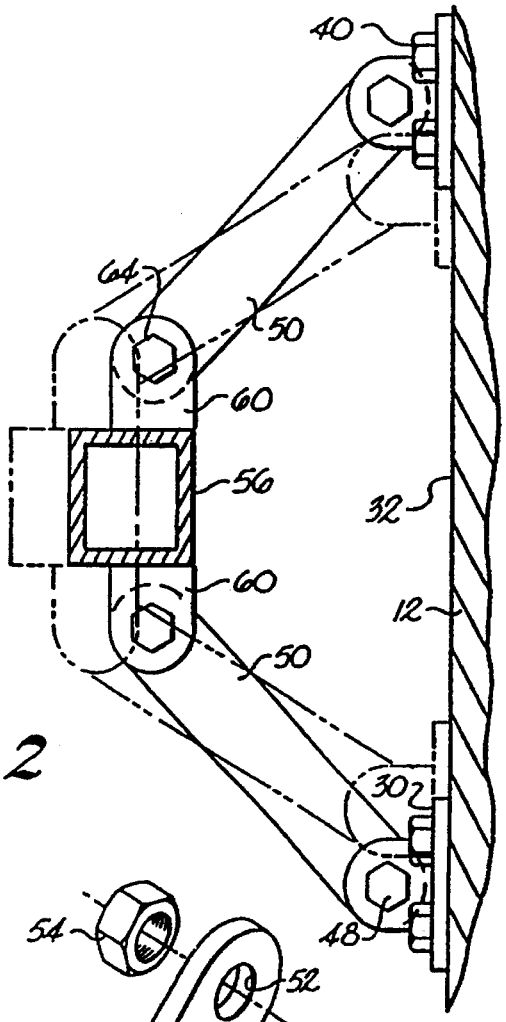
FIG. 2 is a sectional view taken along lines 2—2 of FIG. 1.
Figure 3:
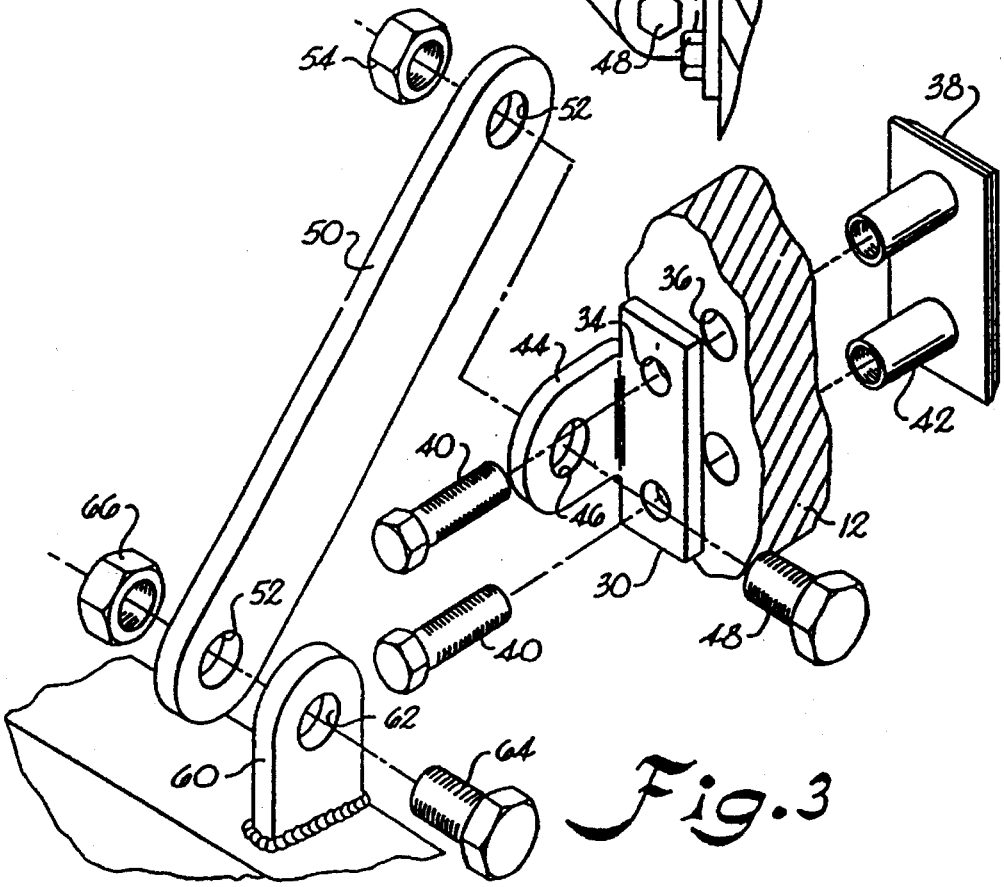
FIG. 3 is a partial perspective exploded view of the mounting structure for a door locking system constructed in accordance with the present invention.

Turning in more detail to the construction of door locking system 10, FIGS. 1 through 3 and 6 illustrate the mounting of locking system, or device, 10 to door 12. Mounting structures, generally 27, include mounting plates 30 which are provided for placement against interior surface 32 of door 12. Mounting plates 30 are provided with holes 34. Door holes 36 are provided through door 12 corresponding to holes 34 of mounting plates 30. A receiving member 38, as shown in FIG. 3, is provided for receiving bolts 40, which pass through holes 34 of mounting plates 30 and which are received in threaded bosses 42. Threaded bosses 42 are fixedly attached to receiving members 34 by welding, a press fit, or some other suitable attachment means.

Mounting plates 30 include ears 44, each having a bore 46 for receiving a bolt 48. Connected to each ear is a link 50, which has a bore 52 at each end thereof. One end of link 52 is connected to ear 44 through means of bolt 48 passing through bore 46 of ear 44 and bore 52 of link 50. Bolt 48 is retained in place by means of a nut 54. While only one mounting plate 30, receiving member 38, and link 50 structure has been described, there are four such combinations of structures associated with locking device 10, only one of such combination being described for convenience. It is also to be understood that other types of mounting structures could be used with locking device 10, such as unitary mounting brackets or removable brackets which would not include the bolted links 50.

Locking device 10 includes an outer sleeve 56, having a square or rectangular cross section which is preferably constructed of steel, although any other suitable material could be used. An engagement member, or inner sleeve, 58 is carried by outer sleeve 56 for sliding, or telescoping, movement with respect to outer sleeve 56. Inner sleeve 58 is of a cross-sectional design complimentary to that of outer sleeve 56, and in the drawings is shown, as well as outer sleeve 56, as having a square cross-sectional shape. Sleeves 56, 58 are illustrated having a square cross-sectional shape, but sleeves 56, 58 could be of any of a variety of cross-sectional shapes. Although not shown, sleeves 56, 58 could alternately be fashioned from cylindrical stock, such that both sleeves 56, 58 would have circular cross sections. This type of alternate embodiment is discussed below in more detail.

Connected to outer sleeve 56 are outwardly extending flanges 60 which are welded, bolted, or fixed to outer sleeve 56 by suitable means. Flanges 60 each include a bore 62 which is complimentary with a bore 52 of link 50 opposite the end of link 50 which is connected to ear 44 of mounting plate 30. A bolt 64 is provided for passing through bore 62 of flange 60 and bore 52 of link 50 to fix link 50 with respect to flange 60. Nut 66 is provided for maintaining bolt 64 in place. While only one flange 60 and link 50 connection has been described in detail, it is to be understood that there are 3 other such structural combinations provided with locking device 10 which fixedly attach outer sleeve 56 to door 12.

Figure 5:
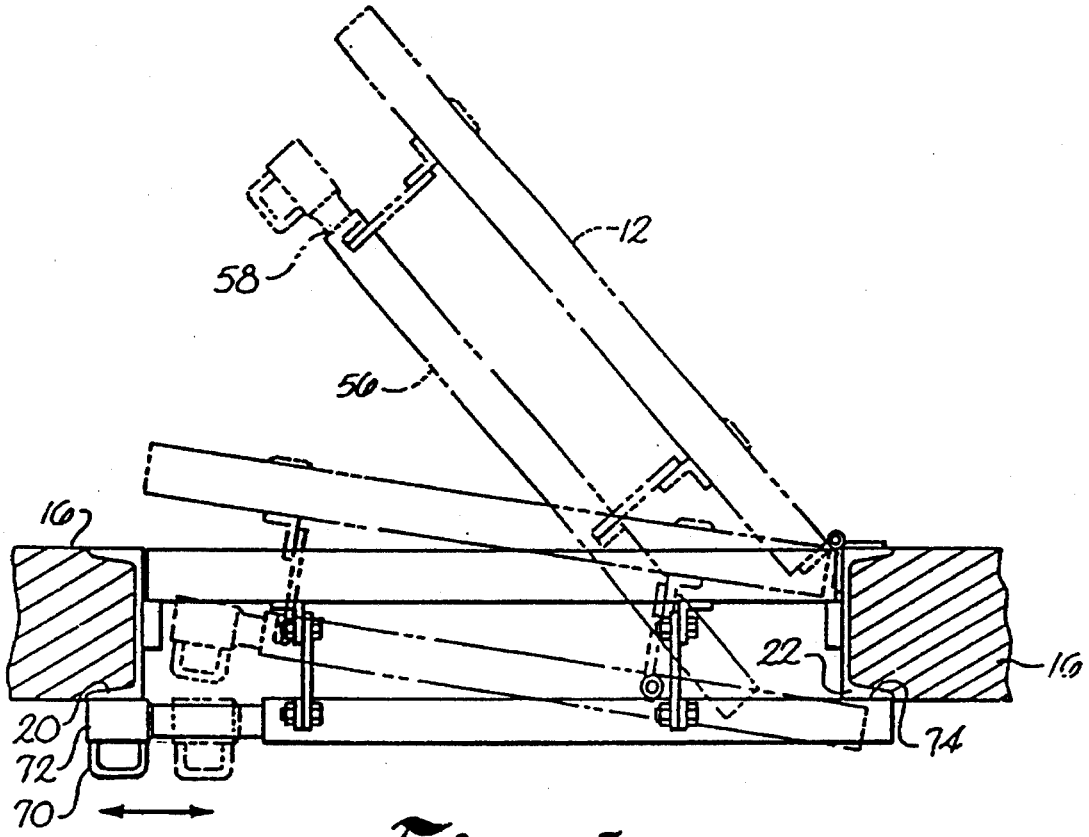
FIG. 5 is a sectional view taken along lines 5—5 of FIG. 1, with a door locking system constructed in accordance with the present invention shown in solid and phantom lines.
Figure 7:
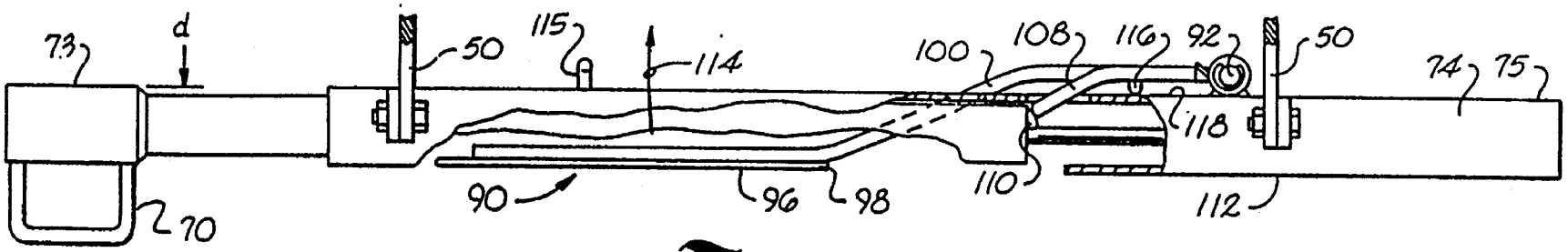
FIG. 7 is a sectional view taken along lines 7—7 of FIG. 6, with parts cut away.

FIGS. 1 and 5 illustrate locking device 10 in a door securing position, with inner sleeve 58 being in an extended engagement position immediately adjacent surface 24 of door frame member 20. Inner sleeve 58 is brought outwardly from outer sleeve 56, against the tension force of a coil spring 68, by means of a handle 70, which is fixedly attached to a door frame contact member 72. Door frame contact member 72 is illustrated as a section of a square sleeve segment having an interior area large enough for receiving the exterior surfaces of inner sleeve 58. Contact member 72 is attached to inner sleeve 58 to provide an added lateral dimension d, as illustrated in FIG. 7, such that engagement surface 73 is substantially coplanar with engagement surface 75 of outer sleeve 74. In other words, the distance between engagement surface 73 and frame surface 24 is substantially the same as the distance between engagement surface 75 of outer sleeve 56 and surface 26 of door frame 18.

Figure 6:
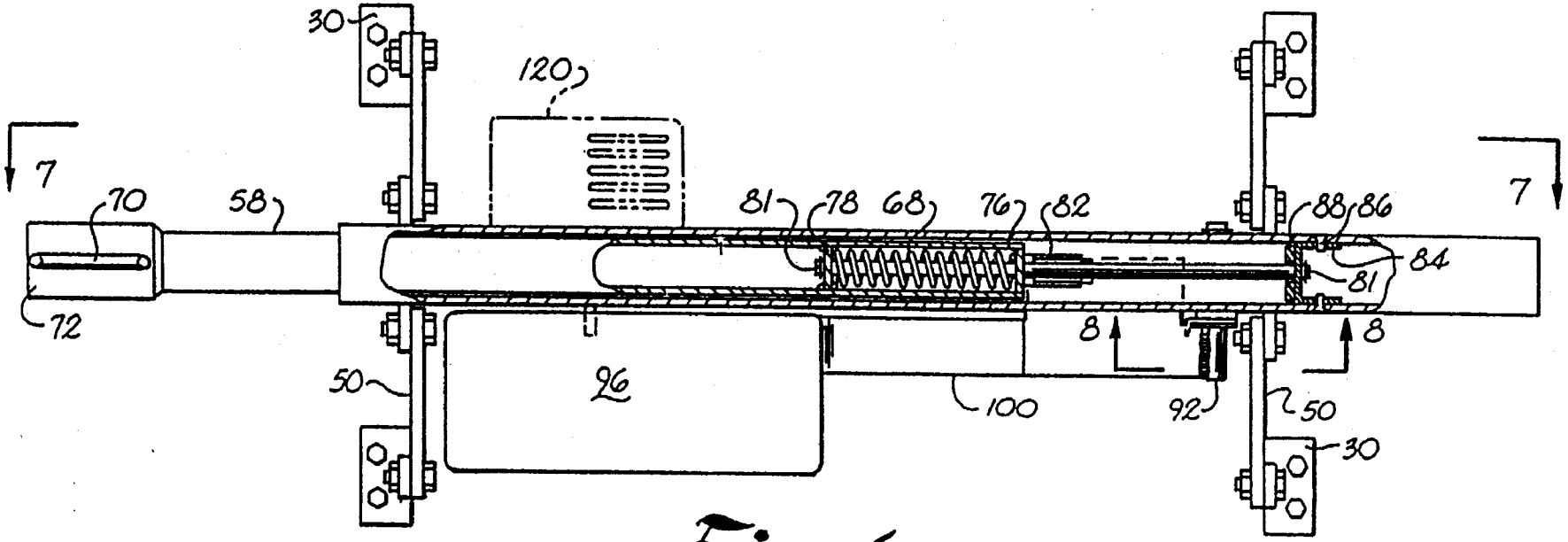
FIG. 6 is a front elevational view, with the parts cut away, of a door locking system constructed in accordance with the present invention.

As set forth above, inner sleeve 58 is pulled telescopically outward from outer sleeve 56 by means of handle 70, through working against spring 68. As illustrated in FIG. 6, spring 68 is captured between an end plate 76 of inner sleeve 58 and an engagement plate 78 connected to a plunger rod 80. While a coil spring 68 is described and illustrated, it is to be understood that the present invention is not limited to such a spring and that a variety of other types of springs, elastic members, or other biasing or retraction means could be used instead. For example, an elastic strap could be used instead of spring 68, or, a mechanical, electrical, electromechanical, pneumatic or hydraulic system, or various combinations thereof, could also be used instead of spring 68 to retract inner sleeve 58.

Engagement plate 78 is retained on plunger rod 78 by means of a clip 81. Plunger rod 80 extends through a bore in end plate 76 and through a bushing 82 attached to end plate 76. The other end of plunger rod 80 is maintained within a retention member 84 held in place within outer sleeve 56 by screws 86. Plunger rod 80 passes through a bore in retention member 84 and is retained in bore by a clip 81. A rubber or elastic stop or bumper 88 is provided having a bore through which plunger rod 80 passes and which is contactable with bushing 76 or inner sleeve 58. Inner sleeve 58 is retained in its extended, door frame engagement position in a manner which will be described in more detail below.

Retraction means for retracting inner sleeve 58 includes a panic bar, or pushbar, 90 is provided which, for upon actuation, causes inner sleeve 58 to retract from its extended position, which prevents door 12 from being opened, to a retracted position further within outer sleeve 56, such that door 12 may be opened. Panic bar 90 pivots in a substantially horizontal plane about an upstanding pin 92 connected to panic bar 90. Pushbar 10 includes a panic contact surface 96 on a panel 98. Panel 98 is fixedly attached to angled lever arm 100 such that panel 98 is substantially parallel to door surface 32 and such that it extends substantially parallel to outer sleeve 56. Although lever arm 100 is shown being disposed from below outer sleeve 56, it could also be positioned above outer sleeve 56. Lever arm 100 is fixedly attached to pin 92, and is received in a journal 102 mounted to outer sleeve by bracket 94. A clip 104 retains pin 92, and accordingly lever arm 100, within journal 102. A torsion spring 106 cooperates with pin 92, and journal 102, to constantly urge lever arm 100 toward outer sleeve 56.

Figure 4:
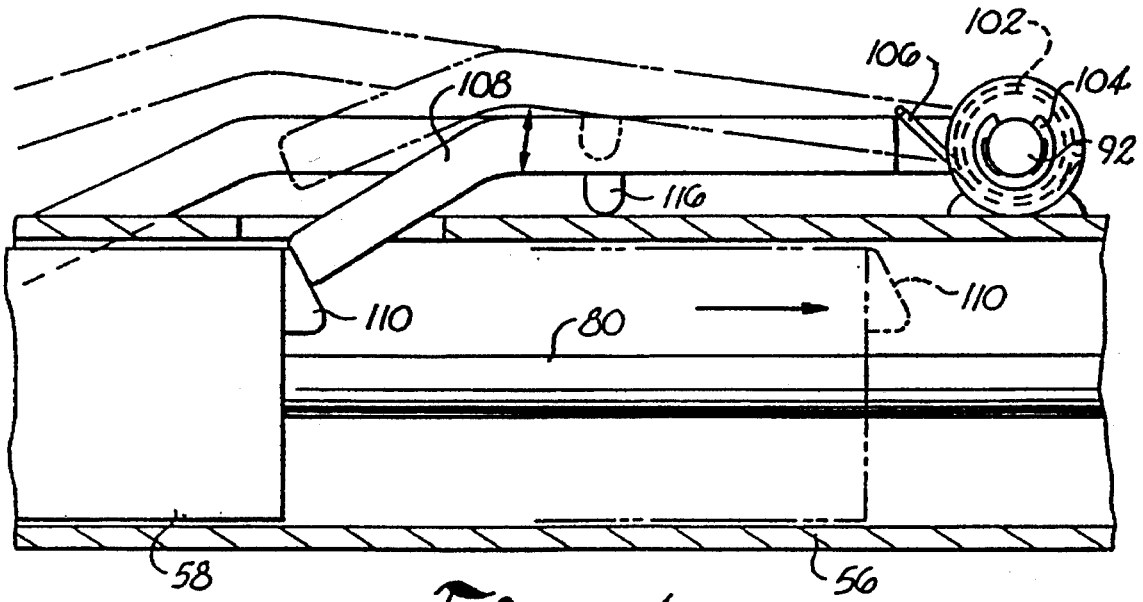
FIG. 4 is a sectional view illustrating movement of a pushbar and an inner sleeve constructed in accordance with the present invention.
Figure 8:
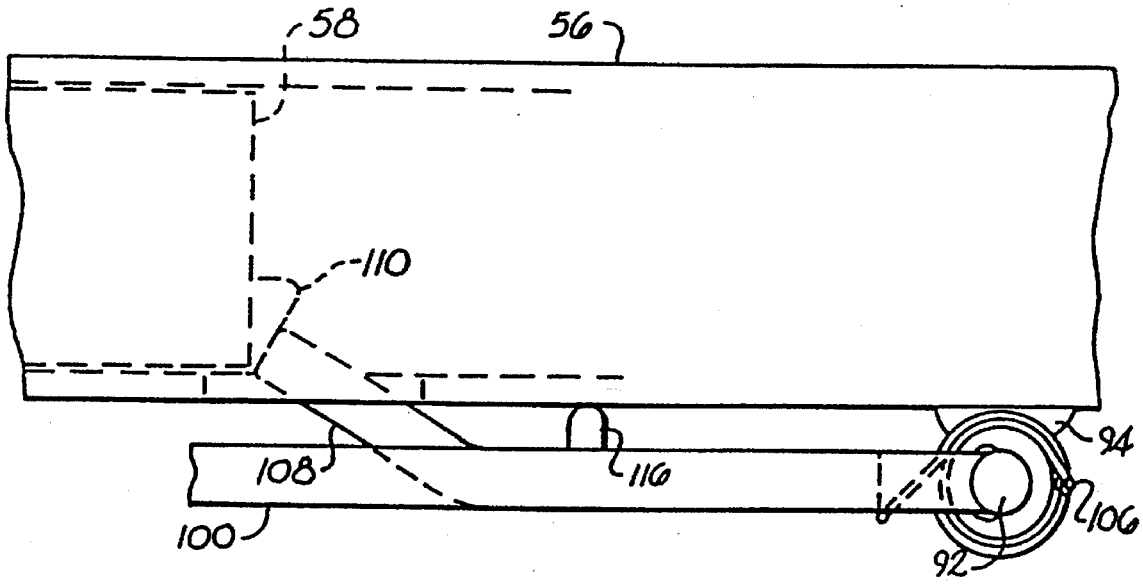
FIG. 8 is a sectional view taken along lines 8—8 of FIG. 6.
Figure 9:
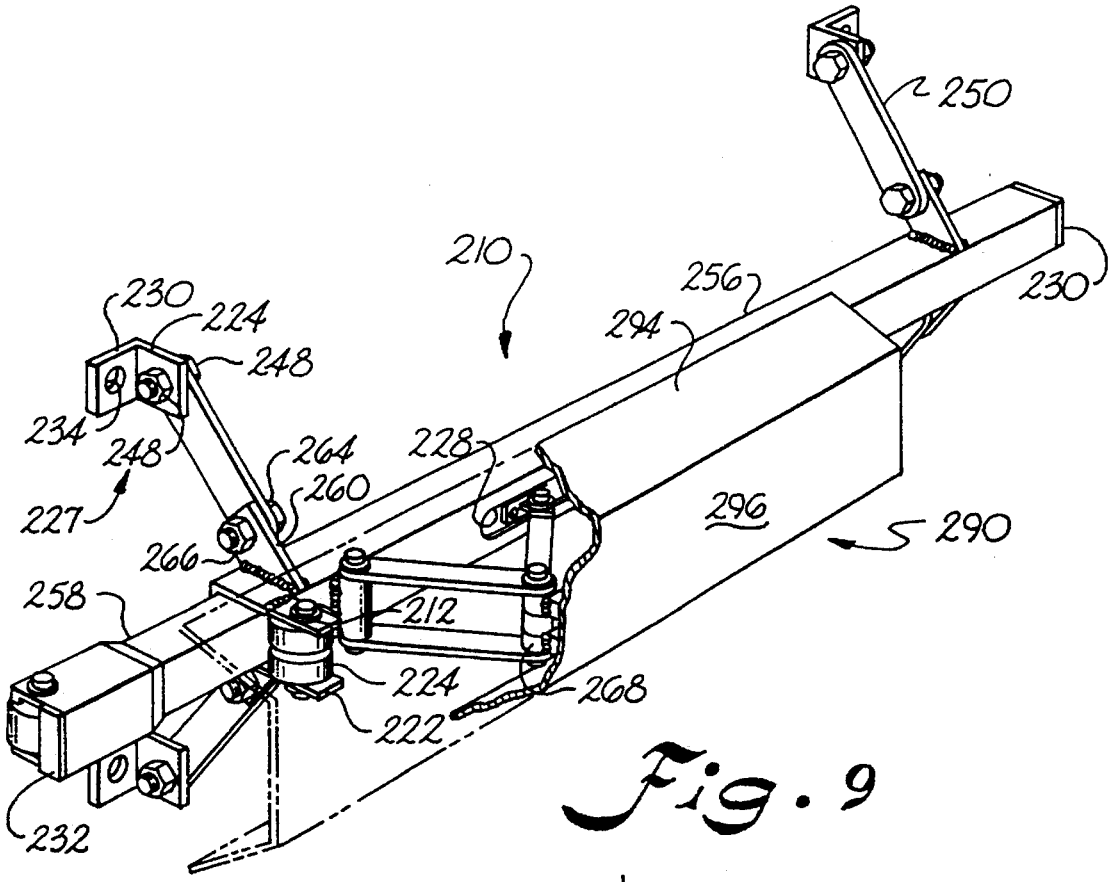
FIG. 9 is a perspective view, with parts cut away, of an alternate embodiment of a door locking system constructed in accordance with the present invention.

FIGS. 4, 7, and 8 illustrate the restraining member, or catch, 108 which cooperates with a ramped stop 110 carried on inner sleeve 58 and end cap 76. When inner sleeve 58 is in its extended, door frame engagement position, torsion spring 106 urges lever arm 100, and catch 108 carried thereon, to a position such that panel 98 is substantially parallel to the forward surface 112 of outer sleeve 56. In so doing, catch 108 moves into place adjacent to, and ultimately in contact with, ramped stop 110 of inner sleeve 58. This engagement between catch 108 and ramped stop 110 prevents retraction of inner sleeve 58 into outer sleeve 56, until panic contact surface 96 is depressed horizontally, in a direction as shown by arrow 114 in FIG. 7. A small projection 116, preferably constructed of resilient material such as rubber or plastic, is provided on lever arm 100 for contacting outer surface 118 of outer sleeve 56 to prevent over-extension of lever arm 100 in a direction away from door 12. An additional rigid stop 115 is provided on outer sleeve 56 for preventing over-extension of lever arm 100 in a direction towards door 12. When panel member 98 is moved horizontally toward door 12, catch 108 clears ramped stop 110, and inner sleeve 58 is immediately retracted into outer sleeve 56 by means of spring 68 acting on end plate 76 of inner sleeve 58. Such retraction of inner sleeve 58 into outer sleeve 56 causes contact member 72 of inner sleeve 58 to clear surface 24 of frame member 20, such that door 12 may be opened.

An alarm means, or box, generally 120, is preferably provided with locking device 10, and is preferably attached to outer sleeve 56. Alarm 120 is of conventional construction, and would be preferably battery-operated. Alarm 120 would be interconnected with pushbar 90 such than upon movement of pushbar 90 toward door 12, alarm 120 would be activated to produce an audible and/or visual alarm, signaling that inner sleeve 58 has been retracted into outer sleeve 56. Alarm box 120 could also include a simple warning light which would indicate when locking device was in an unsecured configuration, namely, when inner sleeve 58 is not in a door frame engaging position.

FIG. 2 illustrates how locking device 10 can be attached to a wide variety of doors. Ears 44, links 50, and flanges 60 cooperate together such that during mounting of locking device 10, outer sleeve 56 can be spaced from door 12 such that end 74 of outer sleeve 56 will be closely adjacent to surface 26 of door frame member 22, and contact surface 72 will be closely adjacent surface 24 of door frame member 20 (upon inner sleeve 58 being in an extended position), when door 12 is closed and latched to member 20. This adjustability feature allows for compensation between door surface 32 and the differing distances which may be presented by surfaces 24, 26 among different doors.

To secure outwardly swinging door 12 from being opened or pulled out of door frame 18 from outside of the building or home, door 12 is first closed into frame 18. At this point, end 74 of outer sleeve 56 is closely adjacent surface 26 of door frame member 22 and extends in front of, or over, member 22. Then, handle 70 is grasped and pulled to extract inner sleeve 58 from outer sleeve 56. Handle 70 is pulled until catch 108 of lever arm 100 engages with ramped stop 110 of inner sleeve 58, which corresponds to contact member 72 being in a door frame engagement position adjacent surface 24 of door frame member 20. Engagement of stop 110 by catch 108 causes inner sleeve 58 to remain in the extended, door frame engagement position. With locking device 10 in this configuration, door 12 is securely held in door frame 18 against opening or removal from outside. Attempts to open door 12 from the outside would cause engagement surfaces 73, 75 to engage door frame members 20, 22, respectively, thereby causing pulling forces applied to the exterior of door 12 to be transmitted also to door frame 18.

In an example use, door lock device 10 could be used on the back door of a store and could be set at night by moving inner sleeve 58 to its extended position at night, prior to closing of the store. In the morning when the store is reopened, panic bar 90 could be moved forward to cause inner sleeve 58 to be retracted by spring 68 into outer sleeve 56 such that the door could be used throughout the day by simply using door knob 14. As shown in FIG. 5, it is not necessary for end 74 of outer sleeve 56 to retract in order for door 12 to be opened, because end 74 is configured to clear frame member 22 when door 12 is opened. Alarm 120 could be selectively temporarily overridden in such day-to-day store openings so as to not be a nuisance. Alternately, door locking device 10 could remain in use at all times on the door, except during emergency situations.

Preferably, door knob 14 is of the type having latching means which can be retained in a retracted position, such that simply pushing on door 12 itself, without turning knob 14, would cause the door to open. This is desired in an emergency situation because door 12 can be opened more quickly and more easily. Alternately, door knob 14 could be a dummy door knob, having no latching means whatsoever. Further, knob 14 could be eliminated altogether, with door 12 being opened and closed by grasping locking system 10.

In emergency situations, locking device 10 can be easily and quickly disengaged through pressing of panel 98 horizontally towards door 12 such that catch 108 of lever arm 100 disengages with stop 110 of inner sleeve 58, thereby causing inner sleeve to retract to within outer sleeve 56. This type of horizontal pressing motion for moving lever arm 100 to retract sleeve 58 is the type of motion fire inspectors typically require for emergency egress devices.

In an alternate embodiment not shown in the drawings, the locking device could be constructed of cylindrical inner and outer sleeves instead of the rectangular cross-sectional inner and outer sleeves shown. In such an alternate embodiment, a coil spring for biasing the inner sleeve inwardly into the outer sleeve could encircle the inner sleeve in the annular region between the outer diameter of the inner sleeve and the inner diameter of the outer sleeve. A ridge or other projection could be provided on a peripheral surface of the inner sleeve within the outer sleeve for engaging one end of the coil spring, and an end cap or other projection could be provided on the outer sleeve to contact the other end of the coil spring. Such an arrangement would bias the inner sleeve inwardly into the outer sleeve, but a catch would be provided as is with the preferred embodiment to retain the inner sleeve in an extended position. The remaining operation and structure of the alternate embodiment would be substantially the same as is the case with the preferred embodiment.

While the retraction means of locking device 10 has been illustrated and described as using a pivotal motion, in the operation of pushbar 90, it is to be understood that the pushbar could be configured to operate in a linear motion, instead of a pivotal motion. In such an embodiment (not shown), the pushbar would slide horizontally towards the door and would cause retraction of the inner sleeve in a manner similar to the retraction mechanisms discussed above.

Another preferred embodiment of the present invention is illustrated in FIGS. 9 through 14. The alternate preferred embodiment, generally 210, is in many ways similar to the embodiment illustrated in FIGS. 1 through 8. The primary difference between the two embodiments is that the alternate embodiment 210 includes means for positively retracting the locking member to allow the door to open, in a manner which will be discussed in more detail below. Throughout FIGS. 9 through 17E, features which are common with the embodiment discussed above are identified by the same reference numbers.

Door lock system 210 is attached to a door 12 through use of four mounting structures, generally 227. Each mounting structure 227 includes a mounting plate 230 having a hole 234 therein for receipt of a bolt, screw, or the like for attaching a mounting plate 230 to door 12. Each mounting plate 230 includes an ear 244 having an opening which receives a bolt 248 for attaching a mounting link 250 thereto. Nut 254 retains bolt 248 with ear 244 and link 250.

While the first end of a link 250 is connected to ear 244, the second end of link 250 is connected to an outwardly extending flange 260. Bolt 264 and nut 266 hold the second end of link 250 to flange 260. Flange 260 is fixed to a support structure having a support member, which is illustrated as being an outer sleeve 256. Outer sleeve 256 acts as a receiver for the door restraining means which in this embodiment is illustrated as an elongated member in the form of an inner sleeve 258.

While only one mounting structure 227 has been discussed concerning door lock system 210, it is to be understood that three other such mounting structures 227 are used in practice to attach door lock system 210 to a door.

Figure 10:
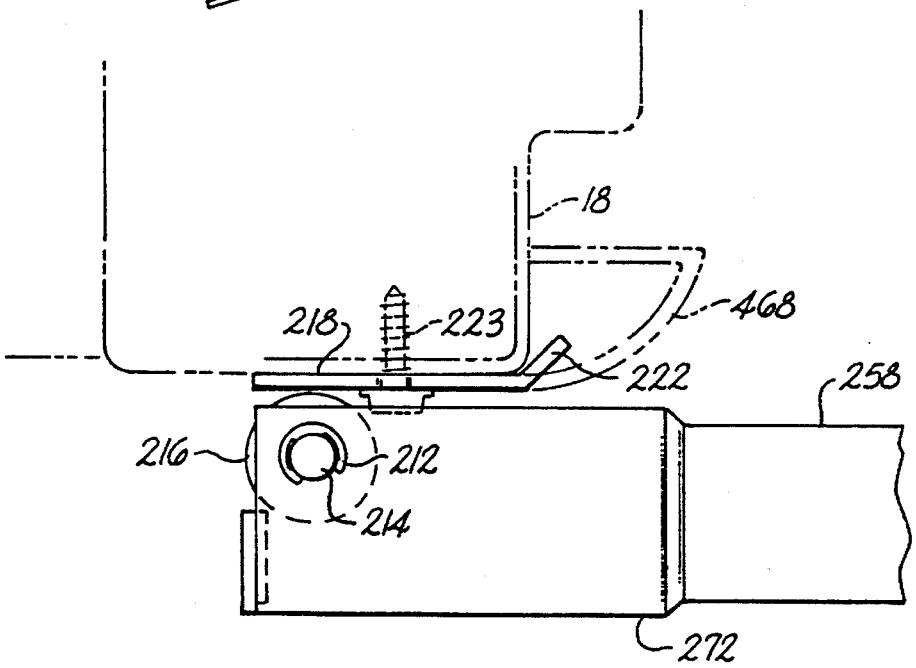
FIG. 10 is a partial plan view of the door locking system shown in FIG. 9.
Figure 11:
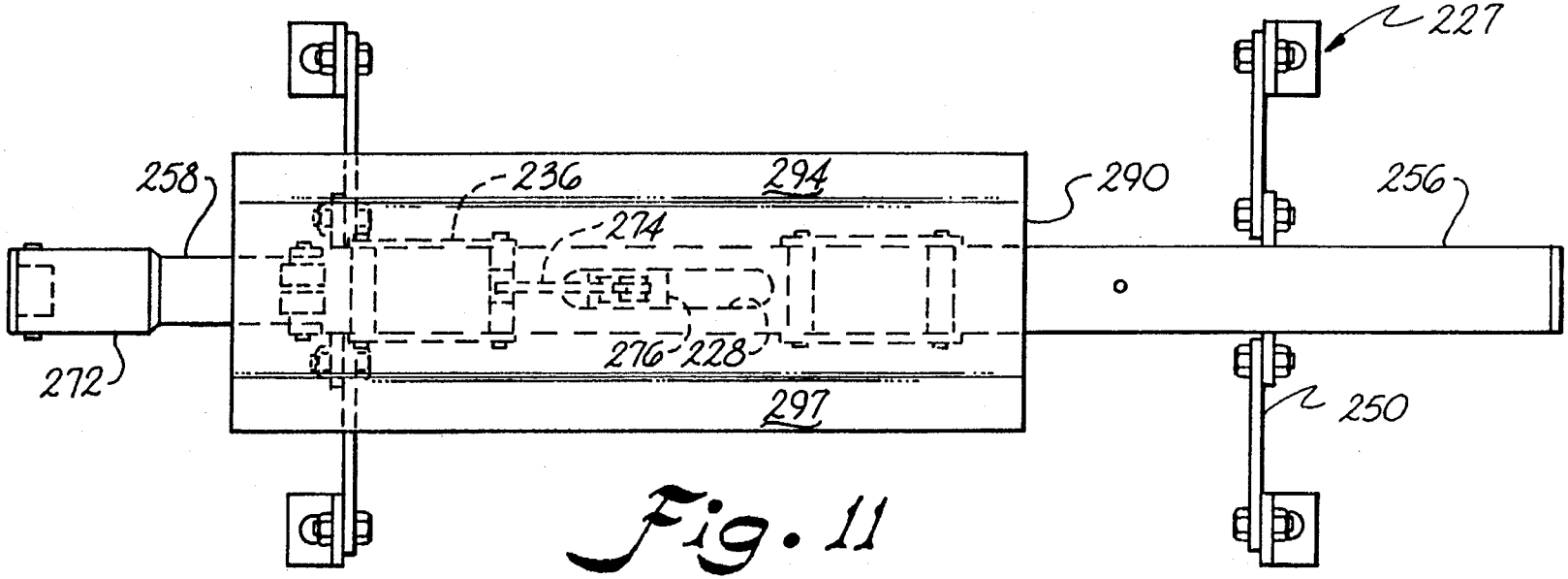
FIG. 11 is a front elevational view of the door locking system shown in FIG. 9.
Figure 12:
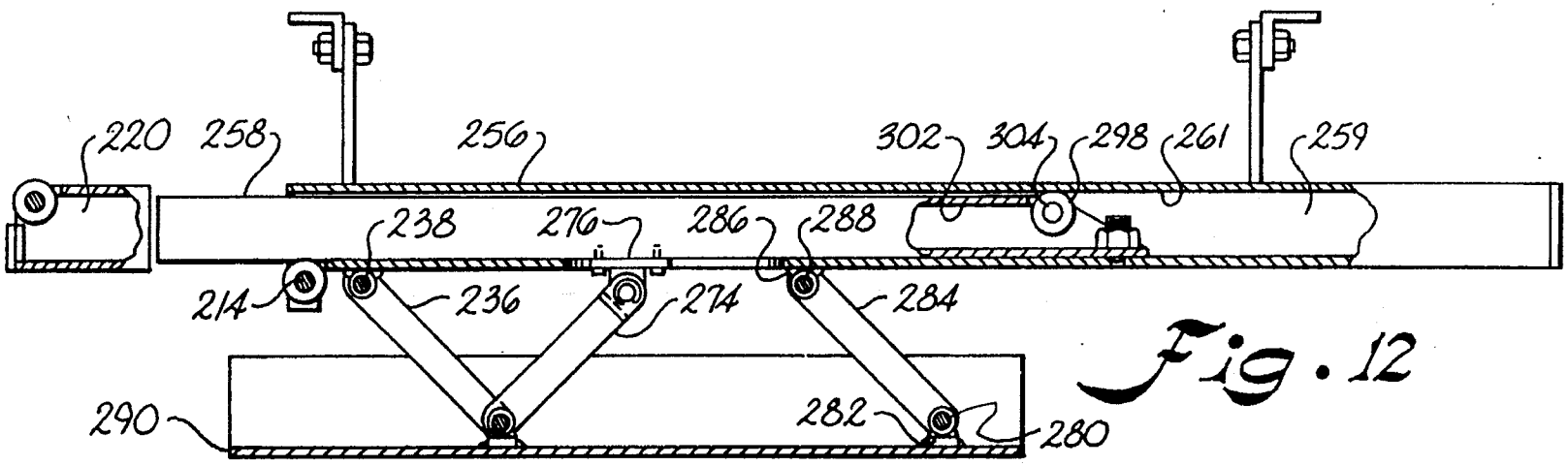
FIG. 12 is a plan view, with parts cut away, of the door locking system shown in FIG. 9.

Inner sleeve 258 is slidable within an interior cavity 259 of outer sleeve 256. Inner sleeve restraining member 258 is pulled outwardly from outer sleeve 256 to a restraining position, as is illustrated in FIGS. 9 through 12. When in the restraining position, restraining member 258 is adjacent to the outer surface of a portion of a door frame 18, as illustrated in FIG. 10.

Also illustrated in FIG. 10 is a contact, or strike, plate 218 which is connected to door frame 18 by means of a screw 223, bolt, or the like. A roller 216 carried within a recess 22 on one end of restraining member 258 bears against strike plate 218 when restraining member 258 is in its restraining position and when restraining member 258 is moved to or from the restraining position. An angled portion 222 is provided on strike plate 218 to insure proper alignment and seating of the restraining member with respect to door frame 18.

Roller 216 is carried for rotation within recess 220 of an enlarged portion 272 of restraining member 258. An axle 214 is provided about which roller 216 rotates, and a retaining ring 212 is provided for securing axle 214 within enlarged portion 272.

Figure 14:
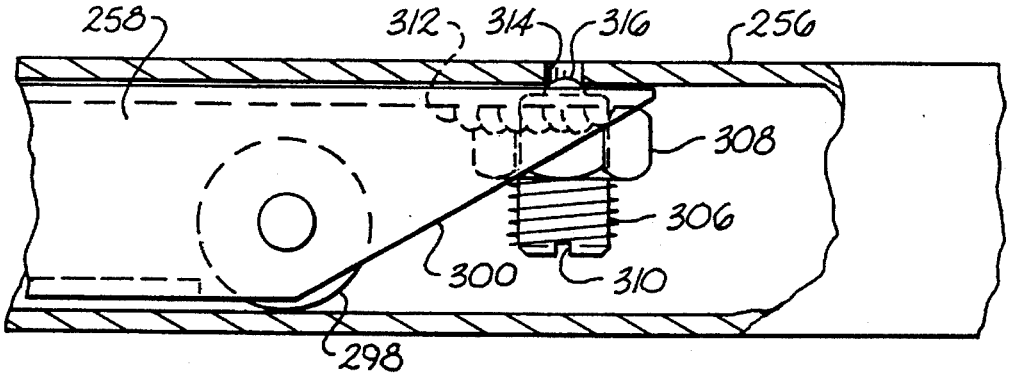
FIG. 14 is a partial, bottom plan view, with parts cut away, of the door locking system shown in FIG. 9.
Figure 15:
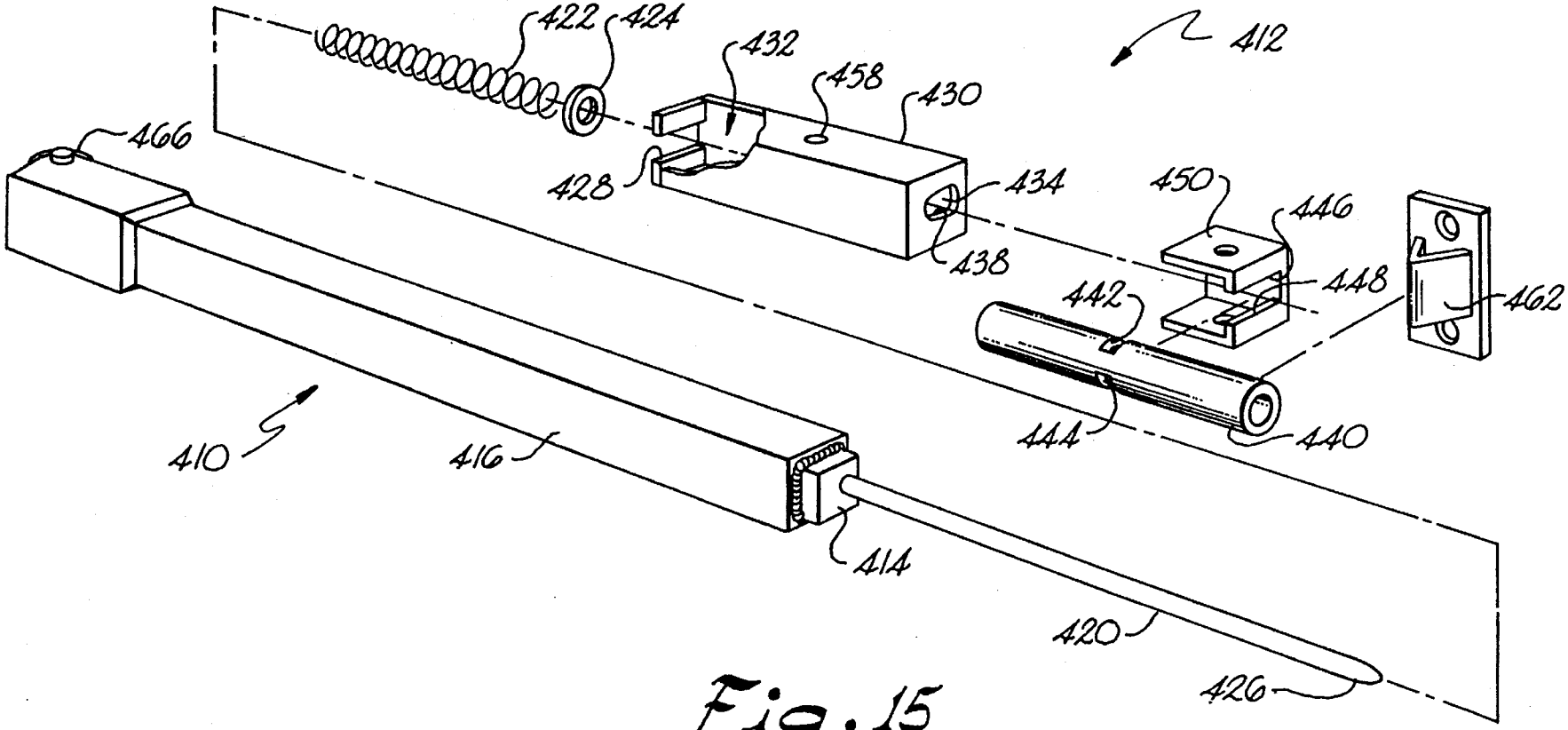
FIG. 15 is a prospective exploded view of another alternate embodiment of a door locking system constructed in accordance with the present invention.

To facilitate sliding movement of restraining member 258 into and out of interior cavity 259 of outer sleeve 256, another roller 298 is provided on the other end of restraining member 258 which rides on a contact surface 261 within interior cavity 259. Roller 298 rotates about axle 304, which is retained in a cavity 302 of restraining member 258. As shown in FIG. 14, angled portion 300 of restraining member 258 provides access to a releasable stop member 316, which is provided in cavity 302 of the rearward end of restraining member 258. Releasable stop member, or ball detent 316 member, is spring loaded within a threaded member 306. Threaded member 306 includes a nut 308 threadingly associated therewith to allow adjustment of ball member 316 with respect to a bore 314 within the outer wall of outer sleeve 256. Nut 308 is fixed to retaining member 258 by a weld 312 or by any other suitable means. Threaded member 306 is provided with a slotted head 310 to allow adjustment of ball detent 316 with respect to the inner surfaces of outer sleeve 256 when retaining member 258 is not in its restraining position. When retaining member 258 is in its retracted position, at its rearward most travel within outer sleeve 256, ball detent 316 engages with bore 314.

Door locking system 210 is actuated upon depression of panic bar, or push bar, 290. Pushbar 290 includes a substantially horizontally disposed member having an upper surface 294, a pushing surface 296, and a lower surface 297. Connected to the opposite side of pushing surface 296 are first, second, and third links 236, 274, and 284, respectively, which allow for movement of push bar 290 with respect to outer sleeve 256 and restraining member 258.

Two first links 236 are provided which are attached at one end thereof to outer sleeve 256 by a pin 238 which is received in a first journal sleeve 242. Journal sleeve 242 is illustrated as being welded to outer sleeve 256, although any other suitable means could be used to fix journal sleeve 242 to outer sleeve 256. Pin 238 is retained in journal sleeve 242 and with first links 236 by at least one clip 246. First links 236 are connected to journal sleeve 242 and pin 238 to allow free pivotal movement between links 236 and outer sleeve 256.

First links 236 are connected at their other end to push bar 290 by means of second journal sleeves 268 which are fixedly attached to push bar 290. A pin 238 and clip 246 are used to retain first links 236 to journal sleeves 268. The connection of first links 236 to journal sleeves 268 is such to allow free pivotal movement of first links 236 with respect to pushbar 290.

A second link 274 is also connected to push bar 290 through receipt in one end thereof of pin 238 which connects first links 236 to second journal sleeves 268. Second link 274 is connected to push bar 290 to allow free pivotal movement thereof with respect to push bar 290. Second link 274 has at its other end a clevis, or other pivotal connection, 275 connected to a sliding receiver 276. Sliding receiver 276 is connected to one end of restraining member 258 by means of bolts 277. Sliding receiver 276 projects outwardly from outer sleeve 256 through a slot, or track, 228 defined along a portion of the length of outer sleeve 256. First links 236 and second link 274 are connected to push bar 290, and second link 274 is connected to sliding receiver 276 such that upon depression of push bar 290 towards outer sleeve 256, second link 274 will cause restraining member 258 to move from a restraining position to a retracted position.

To aid uniform movement of push bar 290 towards outer sleeve 256 during depression of push bar 290, a pair of third links 284 are pivotally connected to push bar 290 by a third journal sleeve 280. Journal sleeve 280 is connected to a mount 282, which in turn is fixedly attached to pushbar 290 by welding. The other end of third links 284 are pivotally connected to outer sleeve 256 by means of a fourth journal sleeve 288, which is attached to outer sleeve 256 by weld 286. Third links 284 are pivotally connected to third and fourth journal sleeves 280, 288 by pins 238, which are held by clips 246. Third links 284 are allowed to pivot freely at the ends thereof with respect to both pushbar 290 and outer sleeve 256, which allows for a smooth depression of push bar 290 during retraction of restraining member 258, thereby allowing for door lock system 210 to be smoothly actuated to unlock door 12 when desired. The motion of push bar 290 during depression generally follows that of a four-bar linkage system. However, it is to be understood, that a variety of other combinations or variations of linkages or mechanical actuation systems could be provided to impart a retraction force on restraining member 258 derived from a horizontally-delivered force imparted to push bar 290.

Figure 13:
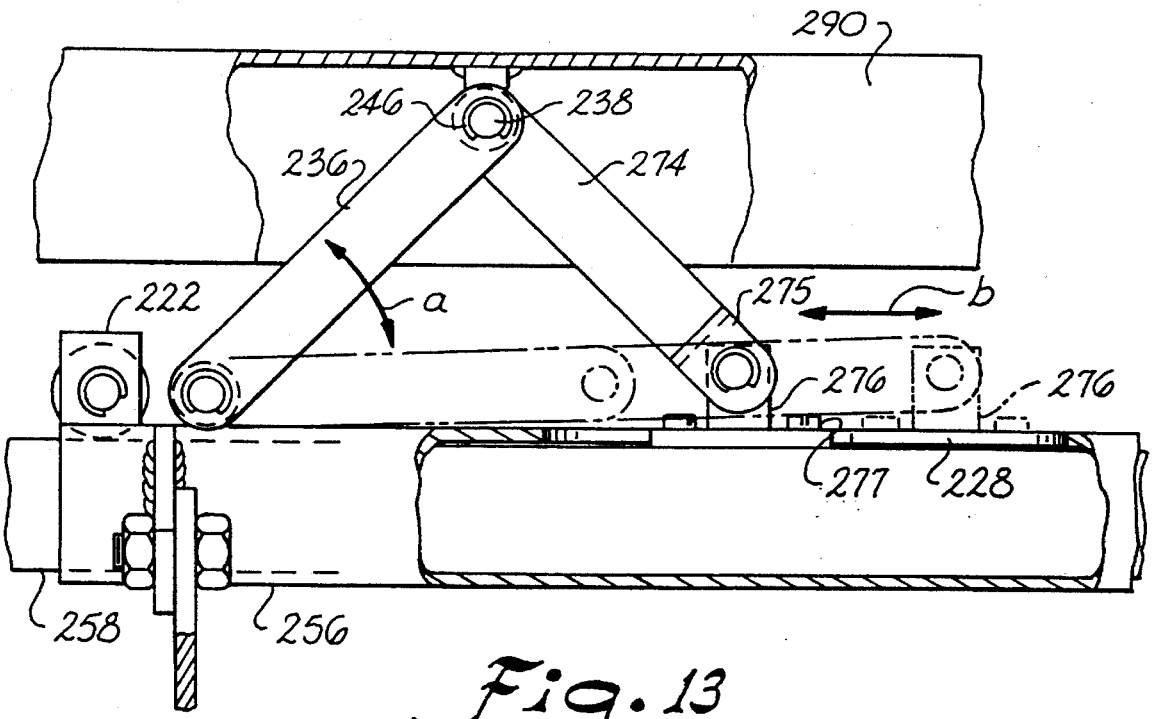
FIG. 13 is a partial, bottom plan view, with parts cut away, of the door locking system shown in FIG. 9.

As can be seen from FIG. 13, during depression of push bar 290, first links 236 follow a path as indicated by arrow a, and the end of second link 274 connected to sliding receiver 276 follows a path as indicated by arrow b.

To facilitate movement of restraining member 258 into and out of outer sleeve 256, a pair of arms 222 are fixedly attached to outer sleeve 256 and carry rollers 224 therebetween. Rollers 224 are provided with an axle 214, held in place by retaining ring 212, and contact restraining member 258 during movement thereof with respect to outer sleeve 256.

An end cap 230 is provided on one end of outer sleeve 256, and another end cap 232 is provided on the exposed end of restraining member 258. End caps 230, 232 are preferably constructed of plastic, have rounded corners, and are provided to limit access to and to enclose outer sleeve 256 and restraining member 258.

In operation of door locking system 210, restraining member 258 is moved to a restraining position by pulling push bar 290 outwardly away from outer sleeve 256. This causes second link 274 to pull against sliding receiver 276, thereby moving restraining member 258 from its retracted position inside of outer sleeve 256 to its outwardly extending restraining position. Once push bar 290 is pulled outwardly to its further most extent, ball member 316 within threaded member 306 is received within bore 314 of outer sleeve 256. This receipt of ball member 316 serves to hold restraining member 258 in its restraining position. However, the force required to overcome the spring biased receipt of ball member 316 within bore 314 is minimal, and is easily overcome upon depression of push bar 290 during retraction of restraining member 258.

It can be seen that door locking system 210 does not require or use a spring for retracting restraining member 258 from a restraining position to the retracted position. A direct mechanical linkage provides the retraction motion of restraining member 258 upon depression of push bar 290. Because a spring is not required to retract restraining member 258, door locking system 210 is able to meet the standards of Underwriters Laboratories, Inc., which do not permit a spring to be used for retraction of a emergency, or panic, door lock. By meeting the standards of Underwriters Laboratories, Inc., door locking system 210 finds widespread applicability.

FIGS. 15 through 17E illustrate still another embodiment of a door locking system, generally 410 constructed in accordance with the present invention. Door locking system 410 is similar to door locking system 210, except that door locking system 410 includes automatic lock resetting means, generally 412 for automatically resetting restraining member 258 in a restraining position.

Automatic lock resetting means 412 includes and end plate 414 being attached to the end of restraining member 416 which is received within outer sleeve 452. End plate 414 is preferably attached to restraining member 416 by welding, but any other suitable attachment means could be used. Also, end plate 414 could be integrally formed with restraining member 416. Fixed to and protruding outwardly from end plate 414 is catch rod 420. Catch rod 420 is preferably offset from the center of end plate 414 in a direction towards door frame 18. A coil spring is 422 provided on catch rod 420 and is interposed between end plate 414 and a washer 424. The free end 426 of catch rod 420 is inserted through an opening 428 in catch box 430. Catch box 430 includes an interior cavity 432 for receiving catch rod 420. Free end 426 of catch rod passes onwards through catch box 430 through a opening 434. At least one notch 436 is provided within catch rod 420 for selective engagement with a tooth 438 of catch box 430 in a manner to be described in more detail below.

Free end 426 of catch rod 420 is received within a guide tube 440, which is open at both ends. Guide tube 440 includes two substantially parallel grooves 442, 444 defined in the exterior surface thereof. Grooves 442, 444 are received between substantially parallel guide surfaces 446, 448, respectively, of a guide member 450.

Catch box 430 is fixed within the interior of outer sleeve 452 by means of welding or by means of a pin 454 passing through a hole in outer sleeve 452 and hole 458 within catch box 430. Guide member 456 is also fixed within outer sleeve 452 by welding or by some other attachment means such as use of a pin 454.

Figure 16:
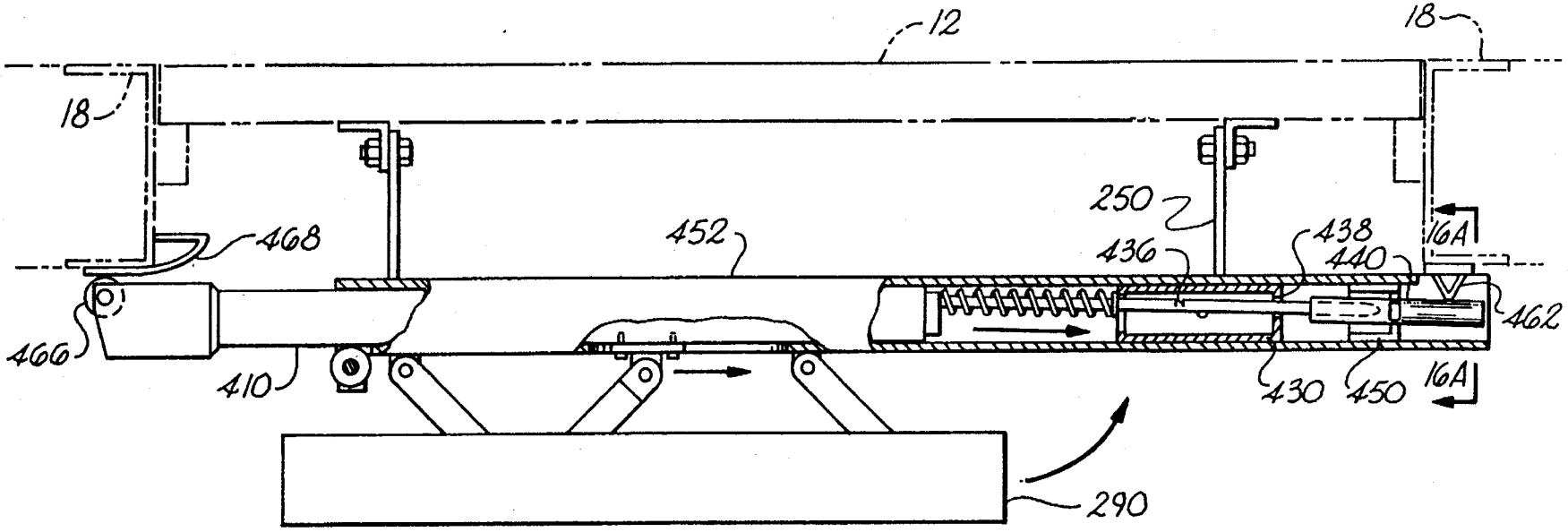
FIG. 16 is plan view, with parts cut away, of the alternate embodiment door locking system shown in FIG. 15.
Figure 17:
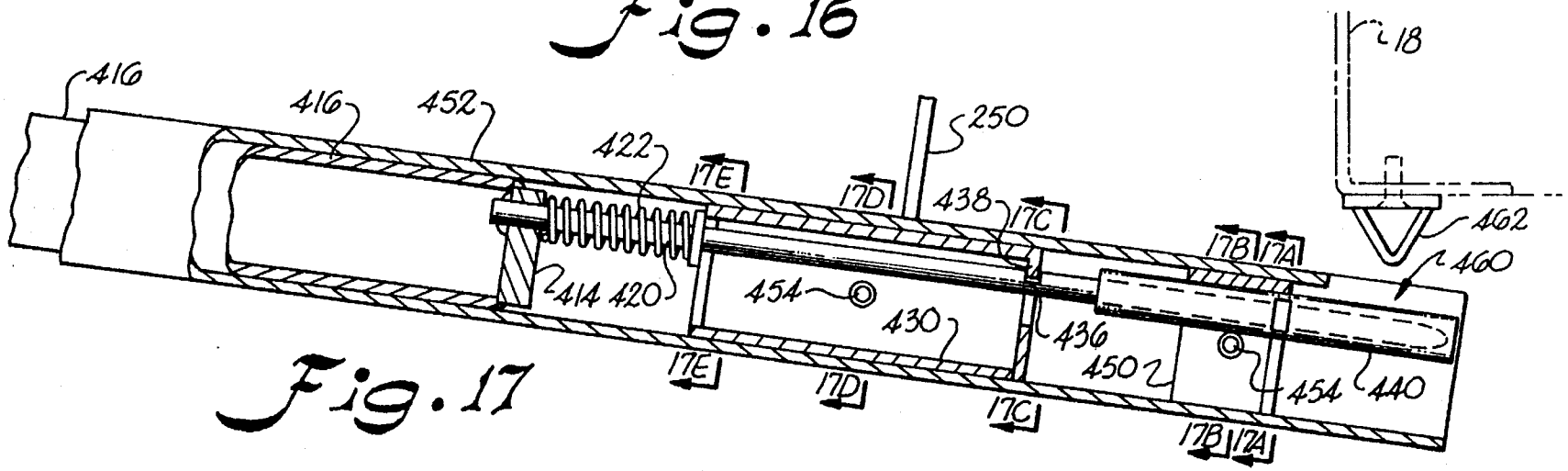
FIG. 17 is a plan view, with parts cut away, of the alternate embodiment door locking system shown in FIG. 15.

Outer sleeve 452 includes an access opening 460 through which guide tube 440 may be contacted. As shown in FIGS. 16 and 17, a striker plate 462 is connected to the door frame carrying the door hinges about which door 12 pivots and is configured for passing through the access opening 460 of outer sleeve 452 and for contacting guide tube 440 when door 12 is closed.

Figure 17A:
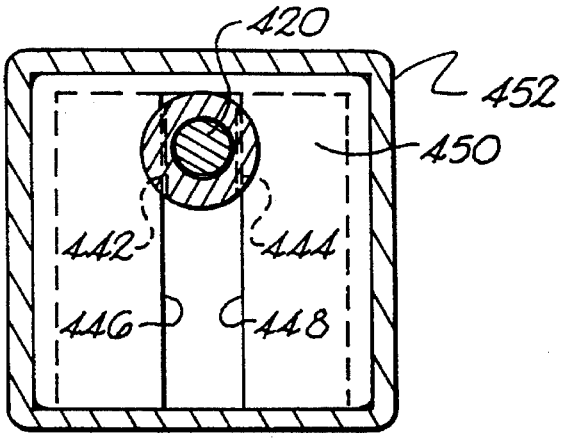
FIG. 17A is a sectional view taken along lines 17A—17A of FIG. 17.
Figure 17B:
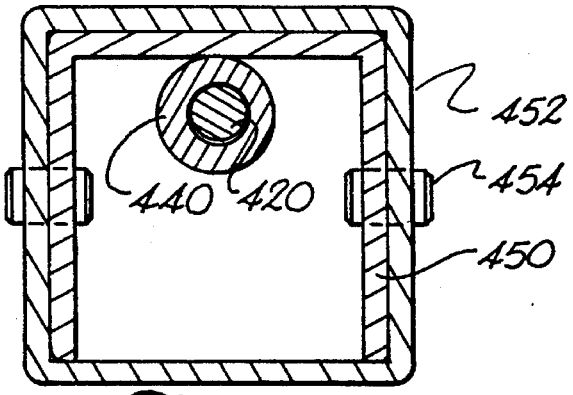
FIG. 17B is a sectional view taken along lines 17B—17B of FIG. 17.
Figure 17C:
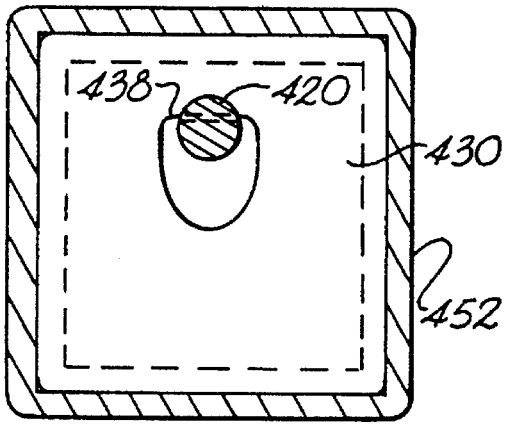
FIG. 17C is a sectional view taken along lines 17C—17C of FIG. 17.
Figure 17D:
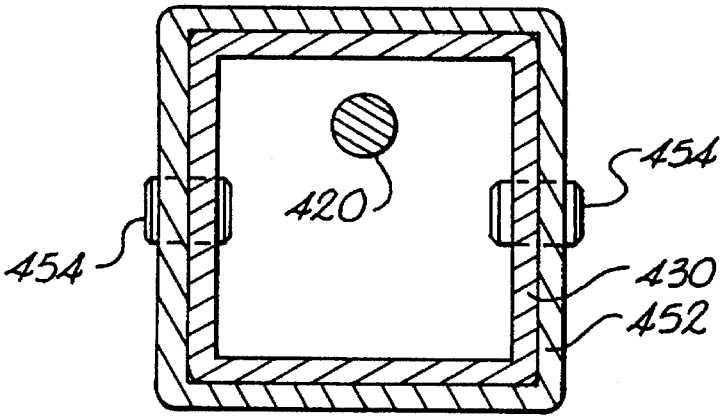
FIG. 17D is a sectional view taken along lines 17D—17D of FIG. 17.
Figure 17E:
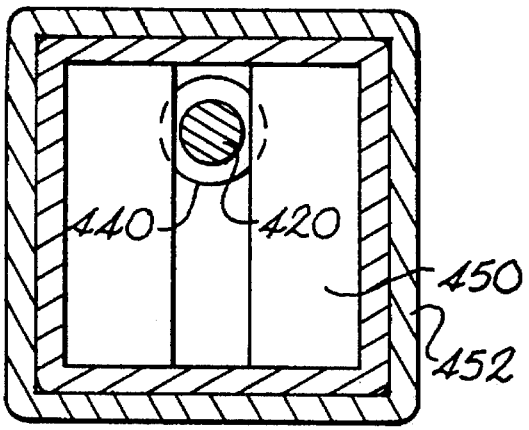
FIG. 17E is a sectional view taken along lines 17E—17E of FIG. 17.

In operation, door locking system 410 is operated with a pushbar and linkage system such as described above in regards to door locking system 210. However, upon retraction of restraining member 416 by the pushbar and associated linkage, restraining member 416 advances rearwardly into outer sleeve 452, which causes catch rod 420 to move through catch box 430. This causes compression of spring 422, and free end 426 of catch rod 420 penetrates further into guide tube 440. Upon complete retraction of restraining member 416 into outer sleeve 452, notch 436 in catch rod 420 engages with tooth 438 of catch box 436, as shown in FIGS. 17 through 17E. This engagement of tooth 438 and notch 436 causes catch rod 420 to remain stationary, with spring 422 in a compressed state, when door 12 is open from door frame 18.

Figure 16A:
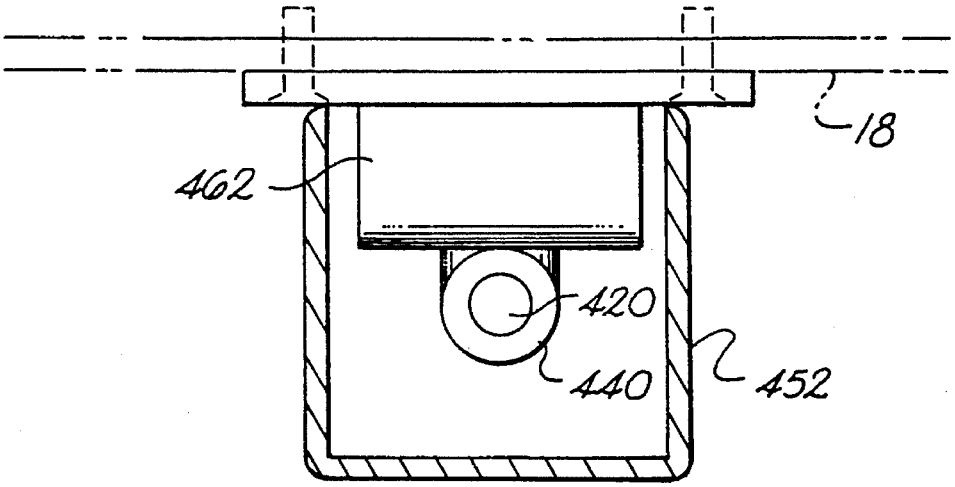
FIG. 16A is a sectional view, taken along lines 16A—16A of FIG. 16.

Upon closure of door 12 into door frame 18, striker plate 462 contacts with guide tube 440 and forces guide tube 440 to move within outer sleeve 452, as shown in FIGS. 16 and 16A, in a direction away from door frame 18. This movement of guide tube 440 causes corresponding movement of the free end of catch rod 420, which in turn causes notch 436 to become disengaged with tooth 438 of catch box 430. Upon disengagement of notch 436 with tooth 438, catch rod 420 is propelled forwardly under the force of spring 422 which now decompresses and forces restraining member 416 outwardly from outer sleeve 452 into its restraining position. Roller 466 carried in the free end of restraining member 416 contacts a curved contact plate 468, as shown in FIG. 17. (Contact plate 468 can also be used with door locking system 210 discussed above, as is shown in FIG. 10.) Contact plate 468 is curved along its length and allows for secure closing and locking of the door within the door frame as restraining member 416 moves to its fully extended restraining position. Even if the door is not completely closed at the time spring 427 releases to force restraining member 416 outwardly, the door will become closed through the interaction of roller 466 being forced outwardly against the curved profile of contact plate 468.

Accordingly, when door locking device 410 is actuated to open the door, restraining member 416 is held in its retracted position so long as the door is open. However, once the door is closed, the restraining member is released from its retracted state within outer sleeve 452, and advances to its restraining position, under the force of spring 422, thereby automatically locking the door again.

Automatic lock resetting means 412 could be of a variety of mechanical, electrical, or electro-mechanical configurations and is not limited to that disclosed herein.

Another the door locking system (not shown) can be adapted such that the restraining member and the free end of the outer sleeve are each received in openings provided in each side of the door frame, respectively, instead of being spaced in front of the door frame as illustrated in the drawings. In such an embodiment, the locking device would operate substantially the same as the above-described embodiments, with the restraining member being moveable to a restraining position the opening of the door frame, and the free end of the outer sleeve being received in an opening of the opposite door frame member when the door is closed. The free end of the outer sleeve would be stationary, and the restraining member would be moveable from a restraining position to a retracted position with respect to the outer sleeve. This embodiment is particularly well-suited where the door frame side members are wide and also where the door is blocked or otherwise prevented from being opened to an extent necessary for clearance of a door locking system to minimize the protrusion of the door lock system in the path of egress through the door frame.

While a preferred embodiment of the invention has been described using specific terms, such description is for present illustrative purposes only, and it is to be understood that changes and variations to such embodiment, including but not limited to the substitution of equivalent features or parts, and the reversal of various features thereof, may be practiced by those of ordinary skill in the art, without departing from the spirit or scope of the following claims.

What is claimed is:

1. A door locking device for attachment to a door, the door being held within a door frame having first and second outer frame surfaces adjacent the door and spaced on opposite sides of the door from one another, the door being hinged proximate the second frame surface for swinging outwardly away from the door frame, the door locking device comprising:

a mounting structure for attachment to the door;

a support structure connected to said mounting structure; said support structure including a stationary extension portion extending over and spaced in front of said second outer frame surface when the door is closed;

at least one restraining member connected to said support structure and movable from an restraining position extending over and spaced in front of the first outer frame surface, for restraining the door from outward movement from the door frame, to a retracted position, for allowing the door to move outwardly from the door frame; and a retraction structure movable from a first position to a second position; said retraction structure being connected to said at least one restraining member for selectively causing said restraining member to be maintained in said restraining position when said retraction structure is in said first position, such that upon a force being delivered to said retraction structure in a direction towards the door, said retraction structure moves to said second position and causes said at least one restraining member to move from said restraining position to said retracted position, thereby allowing the door to swing outwardly from the door frame.

2. A door locking device as defined in claim 1, wherein said retraction structure includes a pushbar associated with said at least one restraining member; said pushbar being movable in a substantially horizontal plane for causing said retraction structure to move from said first position to said second position, thereby causing said restraining member to move from said restraining position to said retracted position.

3. A door locking device as defined in claim 1, wherein said support structure includes a support member fixedly attached to said mounting structure and wherein said restraining member is an elongated member carried by said support member for substantially linear sliding movement relative to said support member.

4. A door locking device as defined in claim 1, wherein:

said retraction structure includes a pushbar associated with said at least one restraining member; said pushbar being movable in a substantially horizontal plane for causing said retraction structure to move from said first position to said second position, thereby causing said restraining member to move from said restraining position to said retracted position;

said support structure includes a support member attached to said mounting structure and wherein said restraining member is an elongated member carried by said support member for substantially linear sliding movement relative to said support member; and wherein said retraction structure includes a first link and a second link, each of said first and second links having a first end and a second end, said first end of each of said first and second links being connected to said pushbar for pivotal movement with respect to said pushbar; said second end of said first link being connected to said support member for pivotal movement with respect to said support member and said second end of said second link being pivotally connected to said elongated member for moving said elongated member upon movement of said retraction structure from said first position to said second position.

5. A door locking device as defined in claim 1, further comprising at least one releasable stop member engageable with said retraction structure for selectively retaining said retraction structure in said first position.

6. A door locking device as defined in claim 1, further comprising alarm means associated with said retraction structure for signalling when said retraction structure is moved.

7. A door locking device as defined in claim 1, further comprising resetting means associated with said restraining member for automatically moving said restraining member to said restraining position from said retracted position upon movement of the door into the door frame.

8. A door locking device as defined in claim 1 further comprising an actuatable catch associated with said support structure for retaining said restraining member in said retracted position when the door is opened outwardly from the door frame.

9. A door locking device as defined in claim 8, further comprising a release member associated with said catch for causing said catch to release said restraining member upon movement of the door into the door frame.

10. A door locking device as defined in claim 9, further comprising a reset member associated with said restraining member for moving said restraining member to said restraining position upon said release member causing said catch to release said restraining member.

11. A door locking device as defined in claim 10, wherein said reset member is a spring.

12. A door locking device as defined in claim 3, wherein said support member is an elongated sleeve having an interior chamber for receiving said restraining member when said restraining member is in said retracted position.

13. A door locking device as defined in claim 4, wherein said support member is an elongated sleeve having an interior chamber for receiving said restraining member when said restraining member is in said retracted position; said elongated sleeve defining an elongated slot through which said second link is connected to said restraining member for moving said restraining member within said elongated sleeve.

14. A door locking device as defined in claim 1, further comprising a contact plate attachable to the first outer frame and at least one roller connected to said restraining member contactable with said contact plate when said restraining member is in said restraining position.

15. A door locking device as defined in claim 4, further comprising a third link pivotally connected to said pushbar and pivotally connected to said support member.

16. A door locking device for attachment to a door, the door being held within a door frame having first and second outer frame surfaces adjacent the door and spaced on opposite sides of the door from one another, the door being hinged proximate the second frame surface for swinging outwardly away from the door frame, the door locking device comprising:

a mounting structure for attachment to the door;

a support structure connected to said mounting structure; said support structure including a support member attached to said mounting structure; said support structure including an extension portion extending over and spaced in front of said second outer frame surface when the door is closed;

at least one restraining member carried by said support member for sliding movement relative to said support member; said restraining member being movable from a restraining position extending over and spaced in front of the first outer frame surface, for restraining the door from outward movement from the door frame, to a retracted position, for allowing the door to move outwardly from the door frame; and a pushbar connected to said at least one restraining member; said pushbar being movable in a substantially horizontal plane, upon a substantially horizontally force being delivered to said pushbar in a direction towards the door, for causing said restraining member to move from said restraining position to said retracted position, thereby allowing the door to swing outwardly from the door frame.

17. A door locking device as defined in claim 16, further comprising a first link and a second link, each of said first and second links having a first end and a second end, said first end of each of said first and second links being connected to said pushbar for pivotal movement with respect to said pushbar; said second end of said first link being connected to said support member for pivotal movement with respect to said support member and said second end of said second link being pivotally connected to said restraining member for moving said restraining member upon movement of said pushbar.

* * * * *